United States Patent [19]

Becker et al.

[11] 4,175,364

[45] Nov. 27, 1979

[54] CASE PACKER HEAD

[75] Inventors: Michael L. Becker, Akron; William G. Wilfong, Mogadore, both of Ohio

[73] Assignee: A-T-O Inc., Willoughby, Ohio

[21] Appl. No.: 890,496

[22] Filed: Mar. 27, 1978

[51] Int. Cl.[2] ..... B65B 21/16

[52] U.S. Cl. ..... 53/539; 53/248

[58] Field of Search ..... 53/497, 539, 543, 248

[56] References Cited

U.S. PATENT DOCUMENTS

| | | | |
|---|---|---|---|
| 3,546,838 | 12/1970 | Alduk | 53/543 X |
| 3,570,216 | 3/1971 | Frentzel | 53/248 |

*Primary Examiner*—Travis S. McGehee

*Attorney, Agent, or Firm*—Oldham, Oldham, Hudak & Weber

[57] ABSTRACT

A case packer head including a grid frame for receiving a plurality of rows of abutted articles therein and a skid blade frame carried by the grid frame for article support and release action are provided, together with a movable support means for the downstream end of the grid frame, and a control member operably engages this support means to move the downstream end of the grid frame vertically so that the grid frame can be inclined downwardly for article loading action and be positioned horizontally for article drop.

11 Claims, 5 Drawing Figures

CASE PACKER HEAD

BACKGROUND OF INVENTION

It is well known in the article packaging apparatus art to supply rows of abutted articles to a case packer grid for positioning on the grid for ultimate deposit into a carrier case placed below the grid, or for other action. Apparatus of the foregoing type is well known and grids for commercial embodiments of article packer apparatus of the type to which the present invention relates includes the grid and article packer apparatus as shown in U.S. Pat. Nos. 3,057,136 and 3,052,071. In such apparatus, slide support bars are provided in the grid and rows of abutted articles are fed into the grid over the slide bars by the pressure of the backup articles awaiting feed to the grid. In some instances, it has been difficult to obtain fast, positive flow of the abutted articles onto the grid and sometimes the grid may not be properly filled with articles because of the feed pressure by the articles awaiting feed to the grid not forcing the articles on the grid to the further end thereof. Or, the articles may slide onto the grid relatively slowly. Feed of elongated containers is especially difficult.

While previously known apparatus has functioned excellently in many instances, it is desirable to provide a more positive entry of the abutted articles onto the grid for deposit into a carrier case and yet to obtain rapid and controlled deposit of articles into carrier cases.

The general object of the present invention is to provide a novel and improved grid for article packer or caser apparatus and wherein the grid and article slide support bars positioned therein can be inclined downwardly in a downstream direction to facilitate movement of streams of abutted articles onto the grid but where the grid and support bars are horizontal when articles are to be dropped therethrough for case filling action.

Another object of the invention is to reduce the amount of pushing forces required to move abutted articles onto a grid from a stream of abutted articles so as to insure rapidly completely filling the grid with rows of abutted articles.

Yet another object of the invention is to position the slide support bars in grids at downwardly inclined angles, which angles can be adjusted for facilitating slide action of articles onto the grid, dependent upon the forces available for moving the articles onto the grid, the material from which the articles are made, the weight and shape of the articles, etc.

Yet another object of the invention is to improve the action of article caser apparatus in rapidly filling grids with articles for rapid safe drop deposit of the articles into carrier cases.

Other objects of the invention are to provide a grid in article caser apparatus wherein the grid can be inclined downwardly for improved sliding of articles onto the grid to occupy the same fully with an array of articles for case filling action; and to elevate the downstream end of the grid to position it horizontally for article deposit action, which lowering and raising of one end of the grid occurs with each feed cycle of the apparatus and is positively controlled in relation to flow of articles and carrier cases into the filling head portion of article caser apparatus.

Yet another object of the invention is to provide a relatively simple, positive acting mechanical control means to regulate the position of the downstream end of a grid to obtain improved grid filling action with all types and shapes of articles, particularly articles that move onto the grid frame slowly or require extra forces for moving them longitudinally of the apparatus to move into and fully occupy a grid frame for ultimate drop deposit down into an associated carrier case.

The foregoing and other objects of the invention will be made more apparent as the specification proceeds.

In the accompanying drawings.

When referring to corresponding members shown in the drawings and referred to in the specification, corresponding numerals are used to facilitate comparison therebetween.

SUBJECT MATTER OF THE INVENTION

Figure 1:
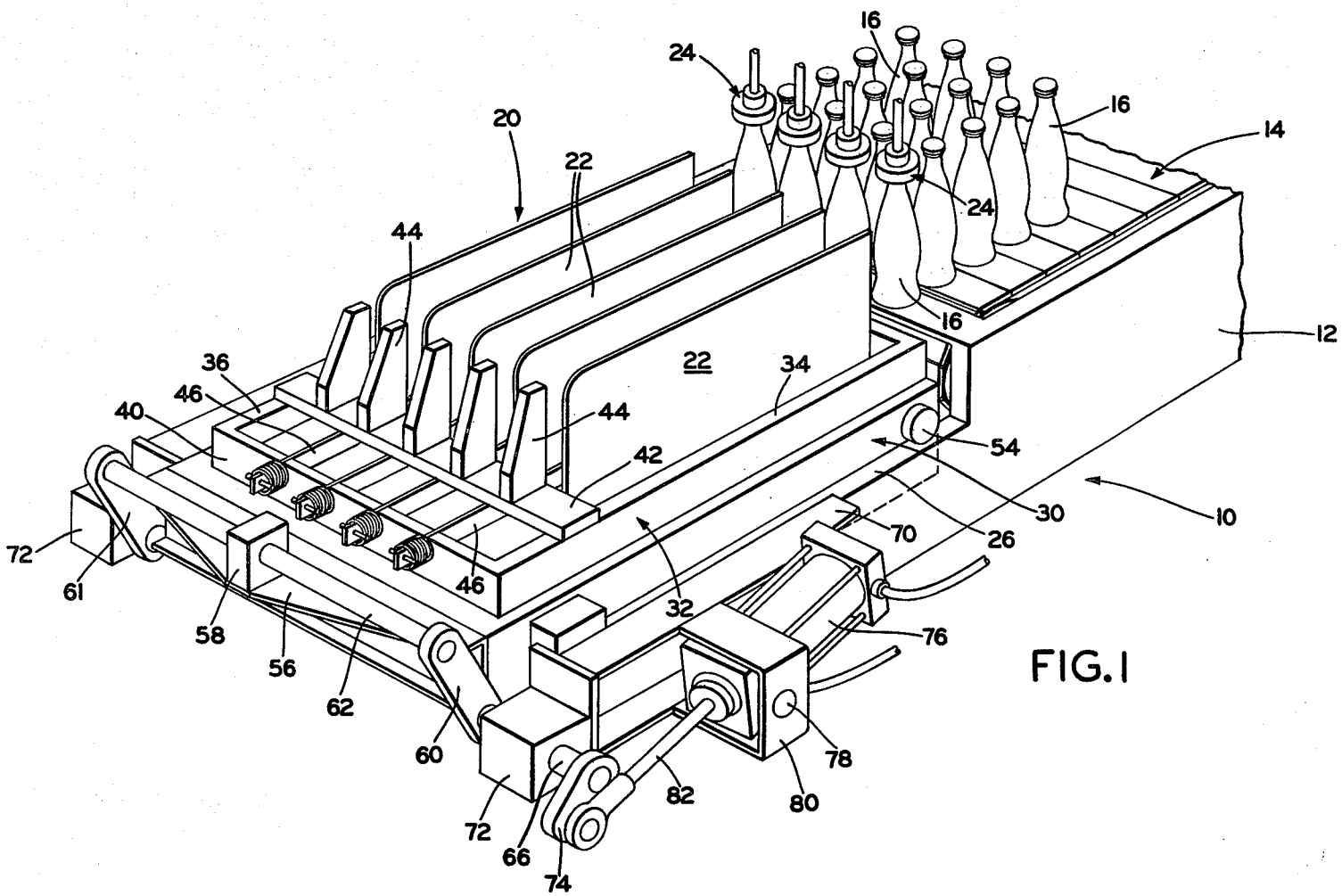
FIG. 1 is a perspective view of the case packing head in association with a portion of a case packer apparatus.
Figure 2:
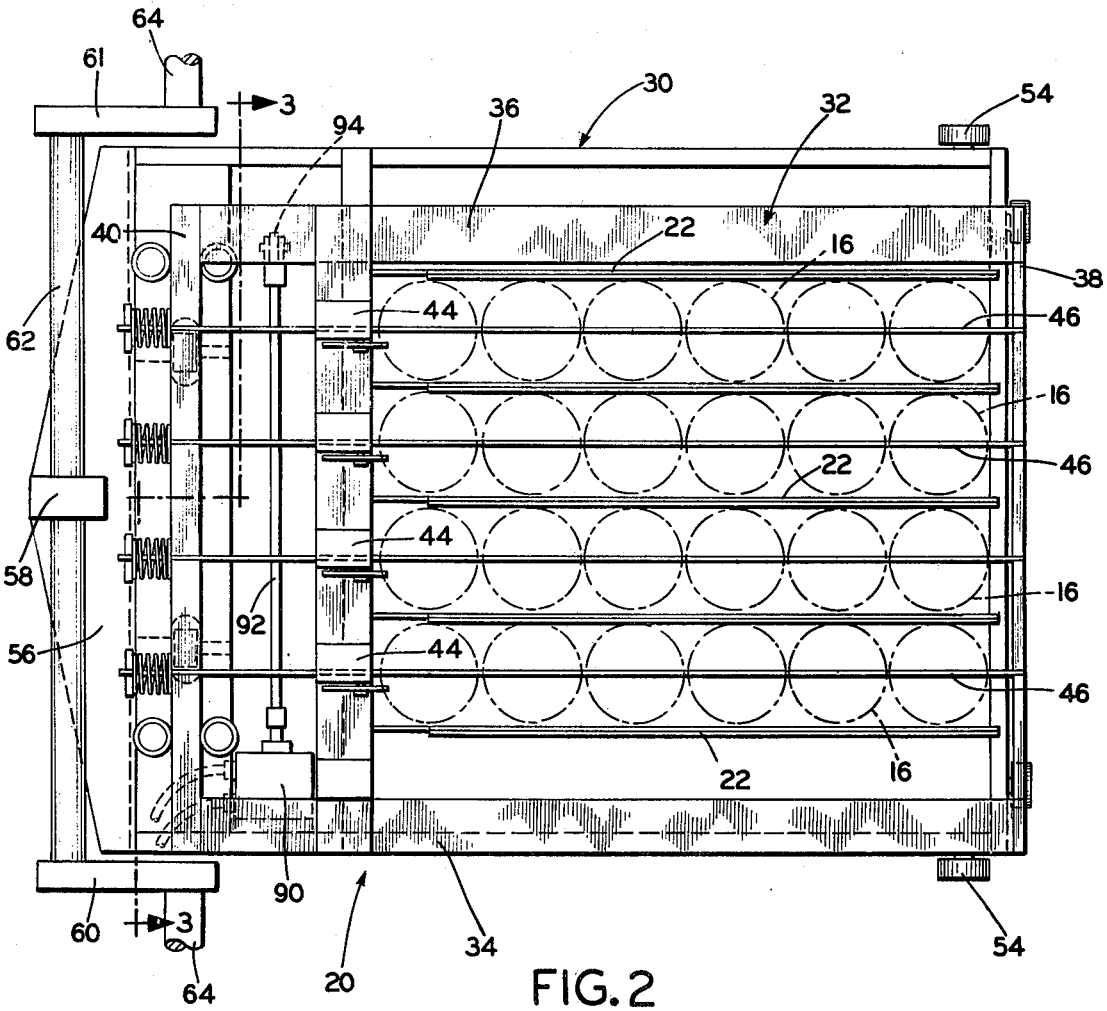
FIG. 2 is a plan view of the case packing head of FIG. 1.

The case packer head of the invention is adapted to be used with minimal change to known types of article packaging apparatus having a frame and means for supplying a plurality of streams of abutted articles to the packing head, the case packer head including a grid frame for receiving a plurality of rows of abutted articles therein, an upstream end of the grid frame being supported on the packing apparatus frame, a skid blade frame operably carried by the grid frame for support of articles moved into the grid frame but movable in relation to the grid frame for article release; and the present improvement is characterized by support means for the grid frame and including a pivotal control arm engaging the downstream end of the grid frame to support the same, and control members operably engage such control arm to move the same through an arc and move the downstream end of the grid frame vertically to incline the grid frame downwardly when the apparatus is set up to load articles onto the case packer head, and to position the grid frame horizontally for article release, which action is correlated with the supply of carrier cases to a lower portion of the apparatus to receive articles from the grid frame as dropped therefrom.

With regard to the details of the apparatus shown in the accompanying drawings, an article packing apparatus is indicated as a whole by the numeral 10. Such apparatus 10 includes a frame 12 and a conventional plate or bar type conveyor 14 is suitably operably mounted on the frame 12 and is driven to move streams of abutted articles in a downstream direction along the frame for deposit onto a case packer head indicated as a whole by the numeral 20. The apparatus is adapted to handle any desired number of streams of the articles 16 and these articles can be of any known shapes, sizes or compositions. The frame 12 of the apparatus likewise is of any conventional construction for smooth transfer or deposit of the articles 16 onto the case packer head. The head 20 is positioned in close relation to the conveyor 14 to receive articles from the conveyor and slide them along between adjacent pairs of a plurality of parallel vertical partitions 22 in the case packer head and extending above the upper surface of the conveyor 14 to aid in maintaining the streams of abutted articles 16 in desired aligned rows as moved onto the case packer head. Conventional members such as vertical movable stops or brake means 24 are provided in the apparatus 10 in a known manner and these brake means 24 are moved vertically to press down against the tops of the articles 16 when it is desired to prevent further flow of articles onto the case packer head 20. These brake members retain the articles in position and prevent further downstream movement thereof even though the conveyor is driven continuously.

Preferably the conveyor 14 is made from a plurality of metal plates extending transversely of the longitudinal axis of the conveyor, which plates form a smooth substantially continuous top surface of the conveyor. The articles 16 are supplied to the conveyor 14 in known manners.

The case packer head 20 is shown received in a recessed portion 26 of the frame 12 so that the frame permits the upstream end of article support means in the case packer head 20 to be substantially level with the horizontally positioned conveyor 14. This aids movement of articles onto the case packer head 20 to fill the same completely with an array of articles positioned in proper abutted and aligned rows so as to fill the carrier case with which the case packer apparatus is designed to be used.

In case packer heads like that shown, it is usual to provide a grid frame 30 which is the main support frame in the packer head and which frame normally is of a rectangular shape and has a plurality of longitudinally extending partitions 22 provided thereon. This grid frame mounts a separate rectangular skid blade frame 32 thereon which skid blade frame is movable in relation to the grid frame to release articles supported on the skid blade frame for deposit into a carrier case by movement down through the case packer head. The skid blade frame is shown diagrammatically in FIG. 1 and includes side bars 34 and 36, an upstream cross bar 38, and a downstream cross bar 40. An auxiliary cross bar 42 is secured to the skid blade frame adjacent the downstream end thereof and it mounts known types of article stops 44 thereon. One of such article stops 44 is positioned in alignment with each row of abutted articles moving over the grid frame between the partitions. This skid blade frame also includes and positions a plurality of longitudinally extending slide bars 46 one of which is located in each article receiving space between each adjacent pair of the partitions 22 to permit article fed to and moving along the grid frame to slide along such support bars for ultimate contact with the article stop 44 at the end of the individual article receiving row. These slide bars 46 are conventionally secured to and extend between the cross bars 38 and 40 of the skid blade frame. The skid blade frame is slightly narrower than the grid frame 30 and is positioned for limited lateral movement in relation to the grid frame, which lateral movement will bring the slide bars 46, that normally are positioned substantially centrally of the spaces provided between the adjacent sets of partitions 22, to a position wherein the slide bars are vertically aligned with and/or are below the partitions 22 whereby articles supported on the slide bars are released therefrom and will drop downwardly of the grid.

As is well known in case packer apparatus, the case packer head has a set of resilient drop fingers 50 suitably operably secured to the grid frame for each article thereon and extending downwardly therefrom at each article receiving area for control of article deposit down through the case packer head, again all as is done in a known manner. These conventional resilient fingers, shown only in FIGS. 4 and 5, guide the articles into a carrier case 52 provided below the case packer head, as is conventional in the art.

The present invention particularly relates to special members for support of the downstream end of the case packer head 20. The upstream end of such head has a pair of support rollers 54 thereon which are supported on a flat area of the frame 12 whereas the downstream end of the case packer head, and particularly the grid frame 30 thereof, has a new support means including an extension bracket 56. A bearing block 58 is fixedly secured to the bracket 56 in any conventional manner. In order to obtain a controlled vertical position and movement of the downstream end of the case packer head and associated means, a pair of control arms 60, 61 are fixedly secured to the ends of a control shaft 62, FIG. 1, that extends transversely of the apparatus. The control arms 60, 61 are parallel to each other. The opposite ends of these control arms 60, 61 are fixedly individually secured to members, such as a stub shaft 64, one of which is journalled adjacent each lateral margin of the case packer head on a portion of the case packer apparatus frame 12. In this instance, a positioning bracket 70 forms a portion of the fixed frame 12 at each side thereof and it extends longitudinally thereof at the side of the case packer head 20 and such bracket 70 has a support block 72 fixedly secured thereto. This support block 72 or similar conventional member has the stub shaft 66 journalled therein and extending from both sides thereof.

Now, in order to control the vertical position of the downstream end of the case packer head 20 (and grid frame 30), a crank arm 74 is fixedly secured to the stub shaft 66, and a powered reciprocal member operatively engages the free end of the crank arm to move it through a control arc. The crank arm and stub shaft unit control the angular relationship of the control arm 60 to the horizontal and, accordingly, the vertical height or position of the downstream end of the grid frame and associated means, as the crank arm 74 and control arm 60 are maintained in a fixed angular relation.

Figure 4:
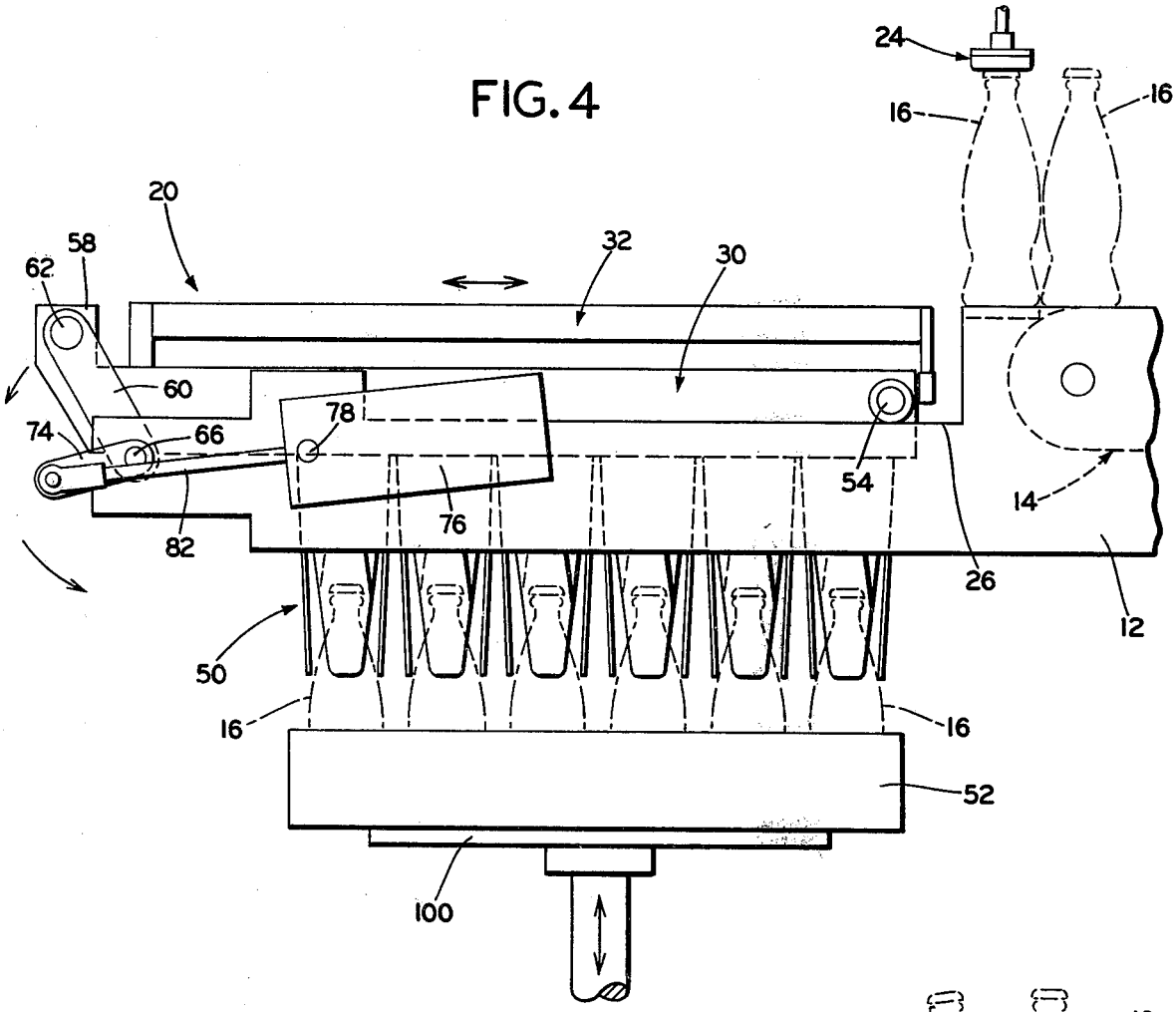
FIG. 4 is a side elevation of the apparatus of FIG. 1 showing the case packer head in its horizontal article drop position, a case being positioned for receipt of such articles.
Figure 5:
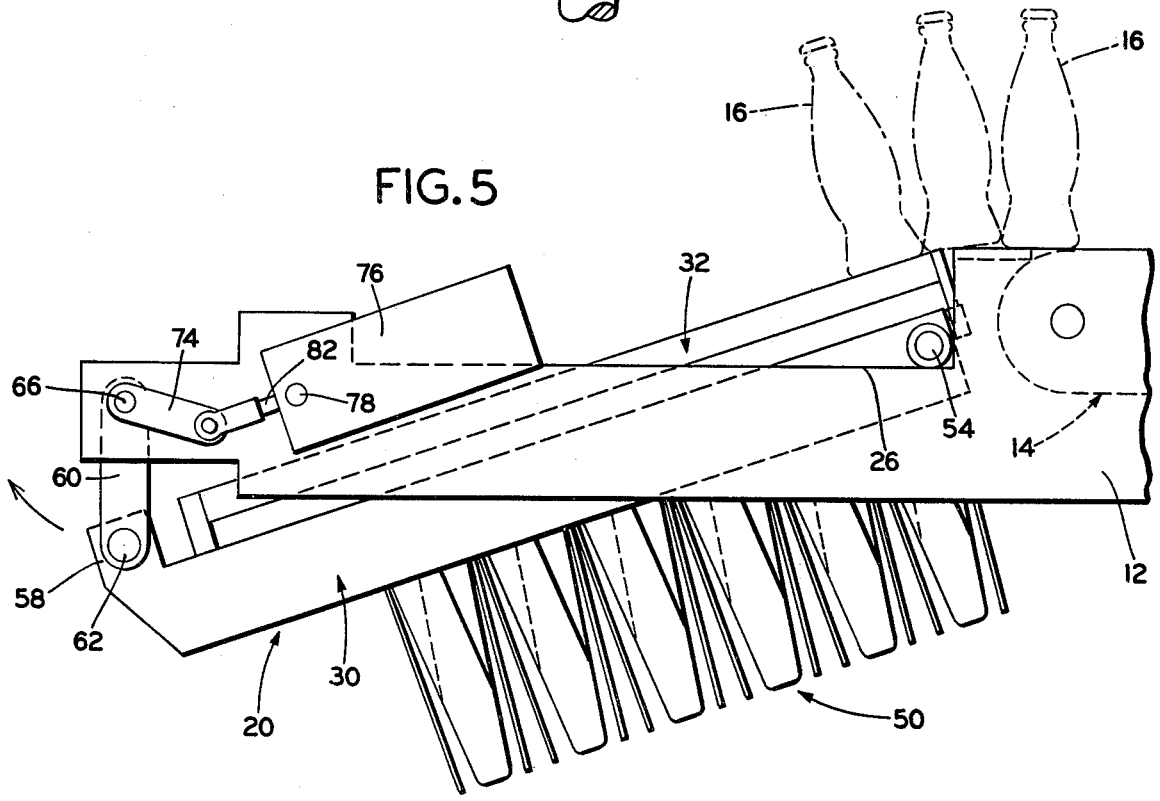
FIG. 5 is a side elevation, like FIG. 4, but showing the case packer head in its downwardly inclined position for article loading action.

In the present apparatus, a suitably powered means, usually a two-way acting air cylinder 76 is pivotally mounted on the bracket 70, and an outrigger plate 80 thereon, as by a trunnion 78, to which the air cylinder 76 is secured thereto whereby this air cylinder is supported on the frame 12 but is pivotal in relation thereto. A piston rod 82 extends from the air cylinder and naturally is controlled by the driven piston positioned therein and such piston rod 82 is pivotally secured to the free end of the crank arm 74. Any suitable adjustment means can be used as a part of the axial length or connection end portion of the piston rod. Or, the piston stroke may be adjustable. FIGS. 4 and 5 show the cylinder 76 and associated means diagrammatically. The relationship of the cylinder 76 to the crank arm and control shaft 62 is such that movement of the piston in the cylinder from one end to the other changes the arcuate positions of the control shaft 62, the control arm 60 and the crank arm 74, all of which are secured to this stub shaft 66 in fixed relationship to each other whereby the control arm 60 will be moved from a sharply upwardly extending position as indicated in FIG. 4 to a substantially downwardly directed position as indicated in FIG. 5. This is accompanied by some change in the position of the air cylinder in relation to the apparatus frame 12.

It should also be noted that the apparatus is designed so that when the piston rod 82 is in its extended position, it has caused the case packer head and grid frame 30 to move longitudinally of the apparatus 12 a short distance on the support rollers 54. But, when the piston rod is retracted, as shown in FIG. 5, the case packer head has been moved upstream of the frame slightly whereby the upstream end of this case packer head is immediately adjacent the conveyor end for convenient flow or slide movement of articles 16 from the conveyor 14 over onto the slide bars 46 for filling the case packer head.

Figure 3:
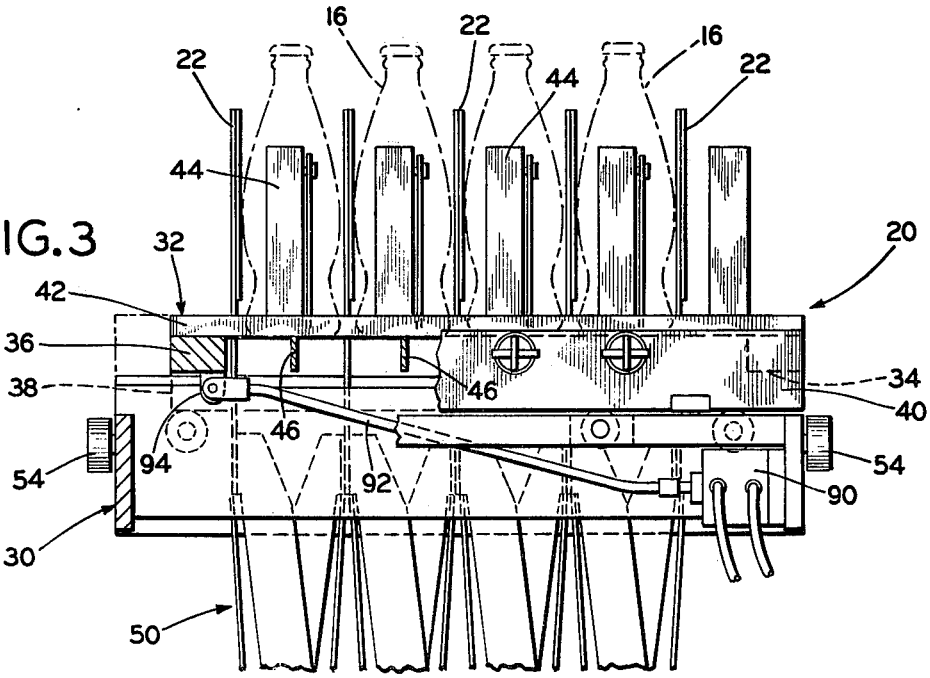
FIG. 3 is a fragmentary vertical section, taken on line 3—3 of FIG. 2, of the case packer head.

For case filling actions, it is necessary to move the skid blade frame 32 laterally of the grid frame 30, and the present invention contemplates the provision of a control cylinder 90, or equivalent means, FIG. 3, within the open center portion of the grid frame 30 on a side rail thereof. Such control member or cylinder 90 has a powered reciprocating unit therein that will cause a connector arm or link 92 extending from the cylinder and connecting to an opposite side bar 36 of the skid blade frame 32 as by a connector block 94 secured thereon and extending therebelow whereby when the control or powered cylinder 90 is actuated, the skid blade frame is moved laterally a sufficient distance as to cause articles on the slide bars 46 to be slid therefrom to drop through the grid into the associated carrier case.

It will be appreciated that any known type of a support plate 100 can be provided in the apparatus and this support plate has the carrier case 52 thereon and movable therewith. The support plate 100 and the movement thereof and feed of cases 52 thereto in the case packer apparatus all is done as known in the art.

It will be appreciated that the brake means 24, the cylinder 76 and the control cylinder or unit 90 all are suitably regulated by the overall control means provided for the case packer apparatus 10 which likewise controls the movement of the support plate 100 vertically of the apparatus so that properly timed and correlated functioning occurs in the apparatus to provide effective controlled, but safe automatic filling of carrier cases with articles by the improved apparatus of the invention. The articles moving onto the case packer head are adapted to slide thereonto more readily because of the downward inclination of the slide bars 46 on the grid frame and then an accurate controlled drop action of the articles is obtained by raising the grid frame up to a horizontal position. Hence, no possible problems are encountered in dropping the articles down through the sets of drop fingers 50 or other means provided in the apparatus to guide the articles into proper nested positions in the carrier case 52, but yet an improved case packing head filling action has been obtained.

Hence, it is believed that the objects of the invention have been achieved by the mechanically controlled, improved case packer head provided by this invention.

While one complete embodiment of the invention has been disclosed herein, it will be appreciated that modification of this particular embodiment of the invention may be resorted to without departing from the scope of the invention.

What is claimed is:

1. A case packer head including a grid frame means for receiving a plurality of rows of abutted articles therein, and a skid blade frame carried by said grid frame means for support of articles moved into said grid frame means but movable in relation to said grid frame means for article release and characterized by support means for the downstream end of said grid frame means to control and vary the position of the same, and control members operably engaging said support means to move one end of said grid frame means vertically to incline said grid frame means downwardly for article loading action and to position said grid frame means horizontally for article drop, and said control members including a controlled power actuated crank arm and stub shaft assembly operably engaging said support means to change the position of said grid frame in relation to the packing action of associated apparatus.

2. A case packer head as in claim 1 and where said support means include a pivotal control arm engaging said frame means to support the downstream end thereof, and where said crank arm operably engages said control arm.

3. In apparatus as in claim 1 where said support means includes a control arm fixedly coupled to said stub shaft, and a driven controlled reciprocating device operably connects to said crank arm to move the same and said control arm through an arc to change the vertical position of said grid frame means at its downstream end.

4. In apparatus as in claim 3 where said reciprocating device comprises a piston and cylinder means, a trunnion means pivotally mounting said piston and cylinder means and said piston has a piston rod pivotally connecting to said crank arm.

5. In an article packing apparatus having a frame, a case packer head including a grid frame means for receiving a plurality of rows of abutted articles therein, an upstream end of said grid frame means being supported on said packing apparatus frame, a skid blade frame carried by said grid frame for support of articles moved into said grid frame means but movable laterally in relation to said grid frame for article release, the improvement characterized by support means for said grid frame means including a pivotal control arm engaging the downstream end of said grid frame means to support the same, and control members engaging said control arm to pivot the same and move said downstream end of said grid frame means vertically to incline said grid frame means downwardly for article loading action and to position said grid frame means horizontally for article release.

6. In apparatus as in claim 5 where said control members include a crank arm and a stub shaft journalled on said apparatus frame, and a driven controlled reciprocating device operably connecting to said crank arm to move same through an arc to change the vertical position of said grid frame means at its downstream end.

7. In apparatus as in claim 6 where said reciprocating device comprises a piston and cylinder means, a trunnion operably positioning said piston and cylinder means on said apparatus frame, and said piston has a piston rod pivotally connecting to said crank arm.

8. In apparatus as in claim 6 where said crank arm and said control arm are both fixedly secured to said stub shaft and where said control arm, crank arm and said reciprocating device and operably associated and constructed as to move said grid frame means longitudinally downstream a short distance when moved from an inclined to a horizontal position.

9. In apparatus as in claim 5 where means position the upstream end of said grid frame means on said apparatus frame for relative movement on the longitudinal axis thereof.

10. In apparatus as in claim 9, where said packing apparatus frame positions the upstream end of said grid frame for horizontal movement, and said control arm and control members cooperate to move said grid frame means horizontally when said control members are actuated.

11. In an article packing apparatus having a frame, a case packer head including a grid frame for receiving a plurality of rows of abutted articles therein, a skid blade frame carried by said grid frame for support of articles moved into said grid frame but movable laterally in relation to said grid frame for article release, the improvement characterized by support means for said grid frame including a movable control device engaging the downstream end of said grid frame to support the same and support means for an upstream end of said grid frame to support it on said packing apparatus frame for movement longitudinally of said packing apparatus frame, and control members engaging said control device to move said downstream end of said grid frame vertically to incline said grid frame downwardly.

* * * * *